US007784410B2

(12) United States Patent
O'Donnell et al.

(10) Patent No.: US 7,784,410 B2
(45) Date of Patent: Aug. 31, 2010

(54) CONSTANT CONTACT SIDE BEARING ASSEMBLY FOR A RAILCAR

(75) Inventors: William P. O'Donnell, Aurora, IL (US); Paul B. Aspengren, Villa Park, IL (US)

(73) Assignee: Miner Enterprises, Inc., Geneva, IL (US)

( * ) Notice: Subject to any disclaimer, the term of this patent is extended or adjusted under 35 U.S.C. 154(b) by 730 days.

(21) Appl. No.: 11/639,899

(22) Filed: Dec. 15, 2006

(65) Prior Publication Data

US 2008/0141896 A1 Jun. 19, 2008

(51) Int. Cl.
*B61F 5/14* (2006.01)

(52) U.S. Cl. ..... 105/199.3; 105/199.2

(58) Field of Classification Search ..... 105/199.1, 105/199.2, 199.3
See application file for complete search history.

(56) References Cited

U.S. PATENT DOCUMENTS

| | | | | |
|---|---|---|---|---|
| 2,259,049 | A | 10/1941 | Swan et al. | |
| 2,301,372 | A | 11/1942 | Cottrell | |
| 3,707,927 | A | 1/1973 | Geyer et al. | |
| 3,735,711 | A | 5/1973 | Hassenauer | |
| 3,910,655 | A | 10/1975 | Willison et al. | |
| 3,915,520 | A | 10/1975 | Hassenauer | |
| 3,957,318 | A | 5/1976 | Wiebe | |
| 4,355,583 | A | 10/1982 | Eggert | |
| 4,567,833 | A | 2/1986 | Hanson | |
| 4,793,720 | A | 12/1988 | Merker et al. | |
| 4,998,997 | A | 3/1991 | Carlson | |
| 5,048,427 | A | 9/1991 | Dumoulin | |
| 5,086,707 | A * | 2/1992 | Spencer et al. | 105/199.3 |
| 5,386,783 | A | 2/1995 | Rhen et al. | |
| 5,601,031 | A | 2/1997 | Carlson | |
| 5,682,822 | A * | 11/1997 | Sunderman et al. | 105/199.3 |
| 6,092,470 | A | 7/2000 | O'Donnell | |
| 6,957,611 | B2 * | 10/2005 | O'Donnell et al. | 105/199.3 |
| 7,152,534 | B2 * | 12/2006 | O'Donnell et al. | 105/199.3 |
| 7,275,487 | B2 * | 10/2007 | O'Donnell et al. | 105/199.3 |

OTHER PUBLICATIONS

Miner Enterprises, Inc.; Constant Contact Side Bearing Retrofit Kit; one-page, two-sides; Geneva, Illinois; undated.

* cited by examiner

*Primary Examiner*—S. Joseph Morano
*Assistant Examiner*—Zachary Kuhfuss
(74) *Attorney, Agent, or Firm*—Law Offices of John W. Harbst

(57) ABSTRACT

A constant contact side bearing assembly for a railcar having a bolster with an upper surface and a walled receptacle upstanding from the upper surface of the bolster. An inner surface of the walled receptacle defines an open-top cavity wherein the side bearing assembly is accommodated. The constant contact side bearing assembly includes a spring and a base. The side bearing assembly base is configured to loosely fit within the walled receptacle and a gap is defined between an outer surface of the side bearing assembly base and the inner surface of the walled receptacle. A railcar engaging surface portion on a friction member is biased by the spring against an underside of the railcar. An adapter is configured to fit between the side bearing assembly base and the walled receptacle to, at least partially, fill the gap between the side bearing assembly base and the interior surface of the walled receptacle thereby positively positioning, both laterally and longitudinally, the side bearing assembly while reducing horizontal shifting movements side bearing assembly relative to the bolster to optimize performance of the side bearing assembly.

33 Claims, 6 Drawing Sheets

FIG. 5
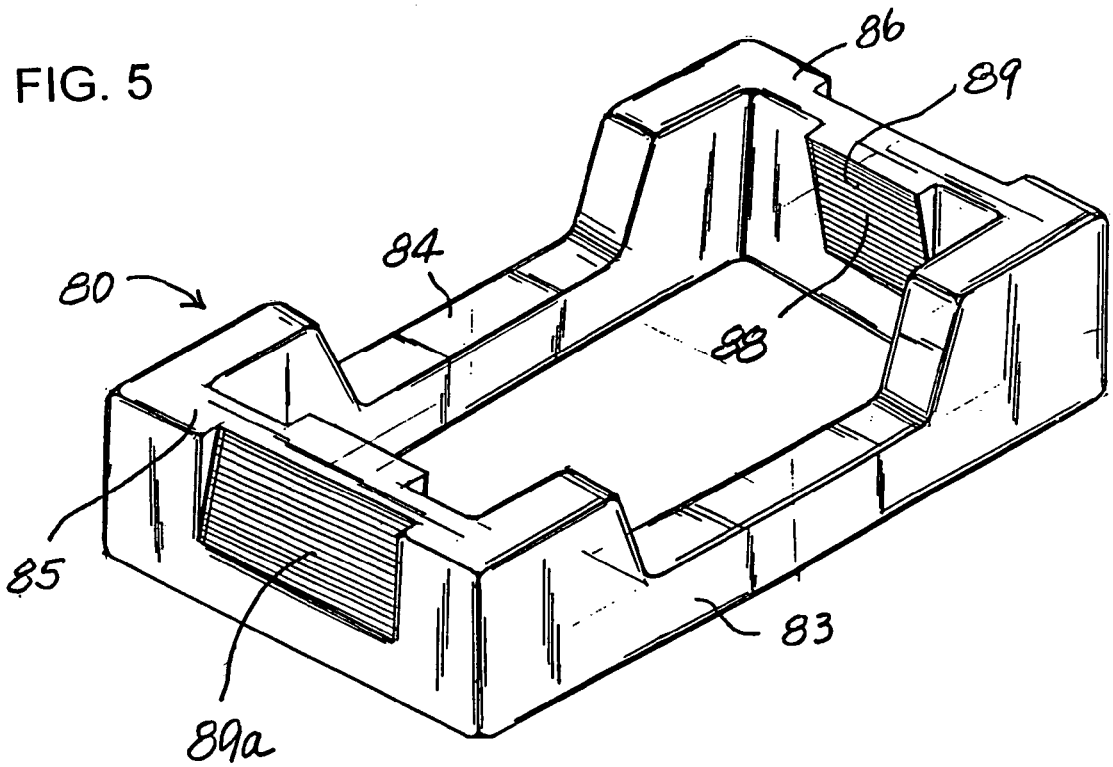
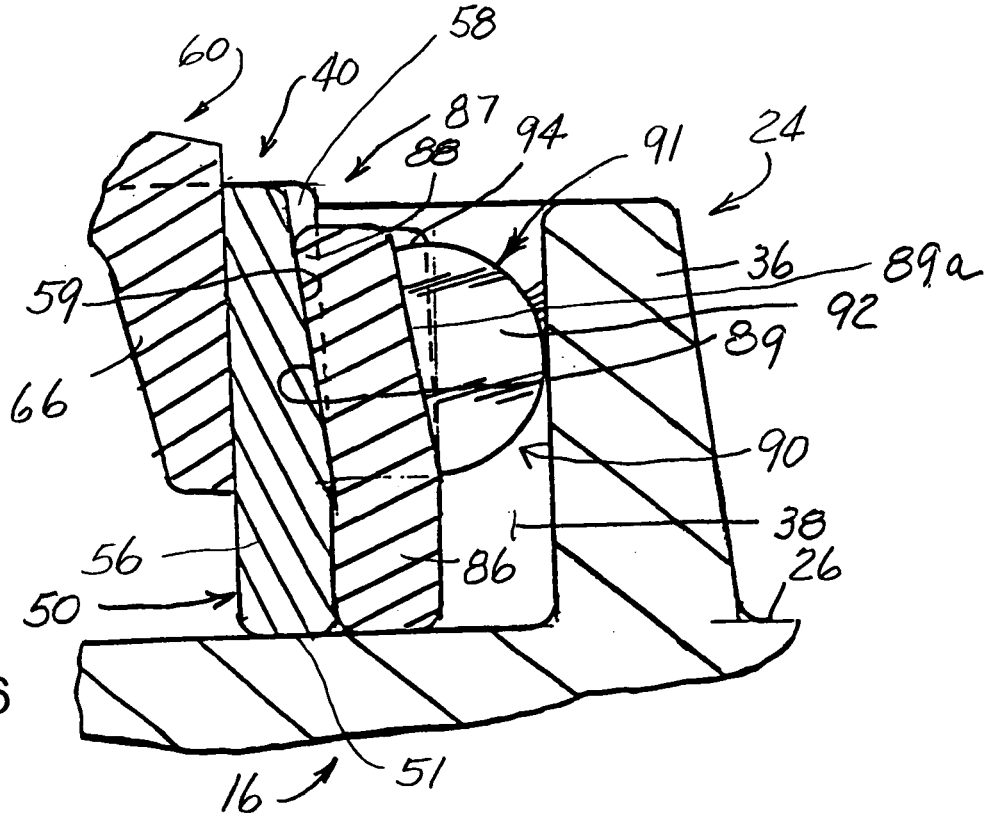
FIG. 6

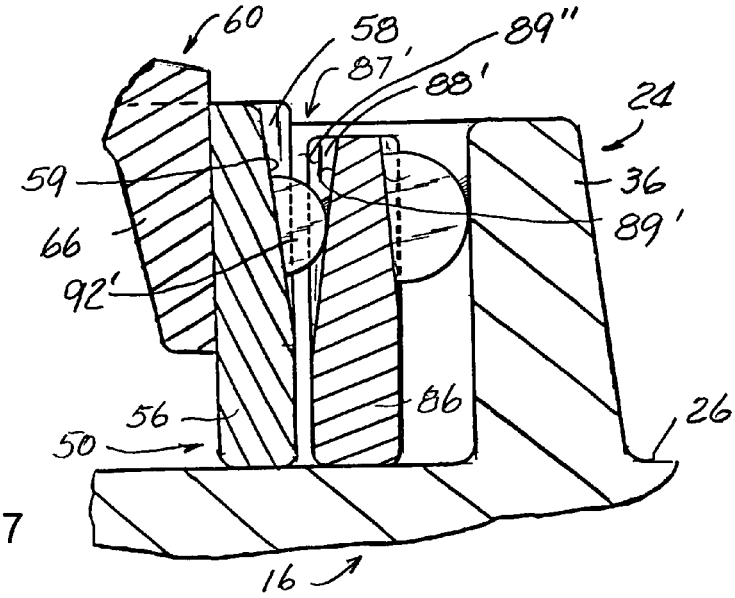
FIG. 7
FIG. 8
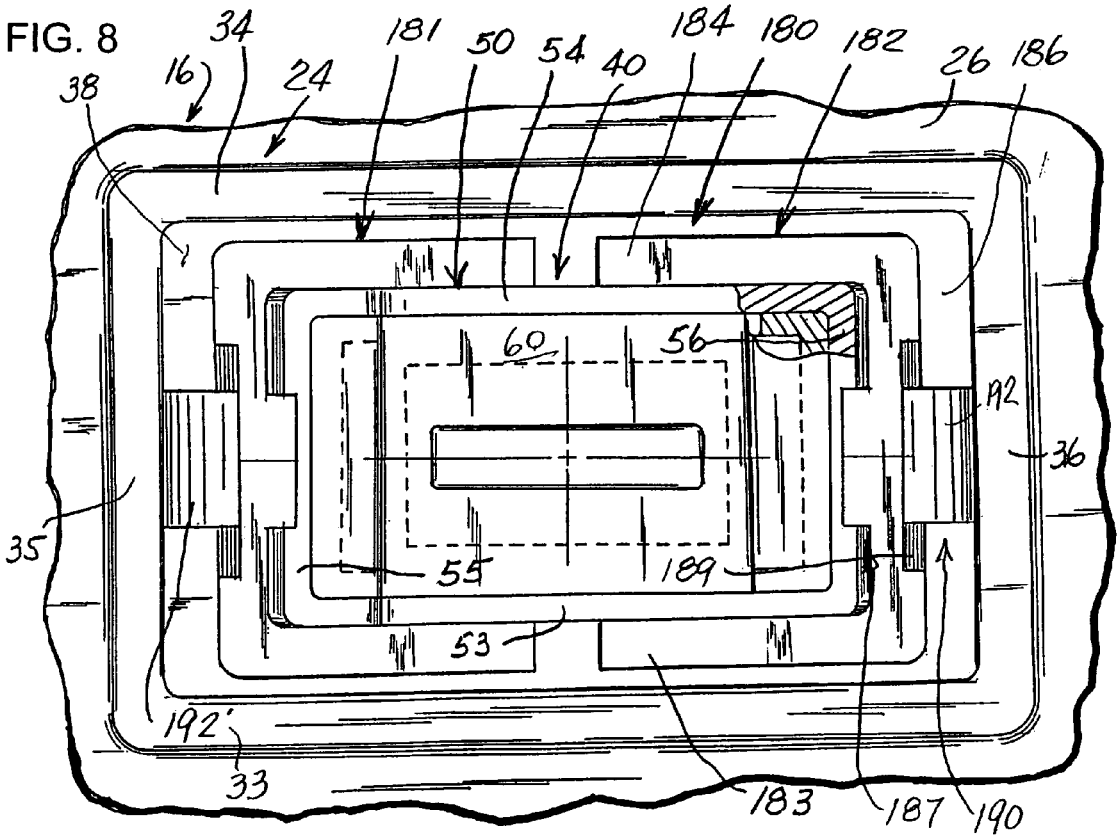

FIG. 9
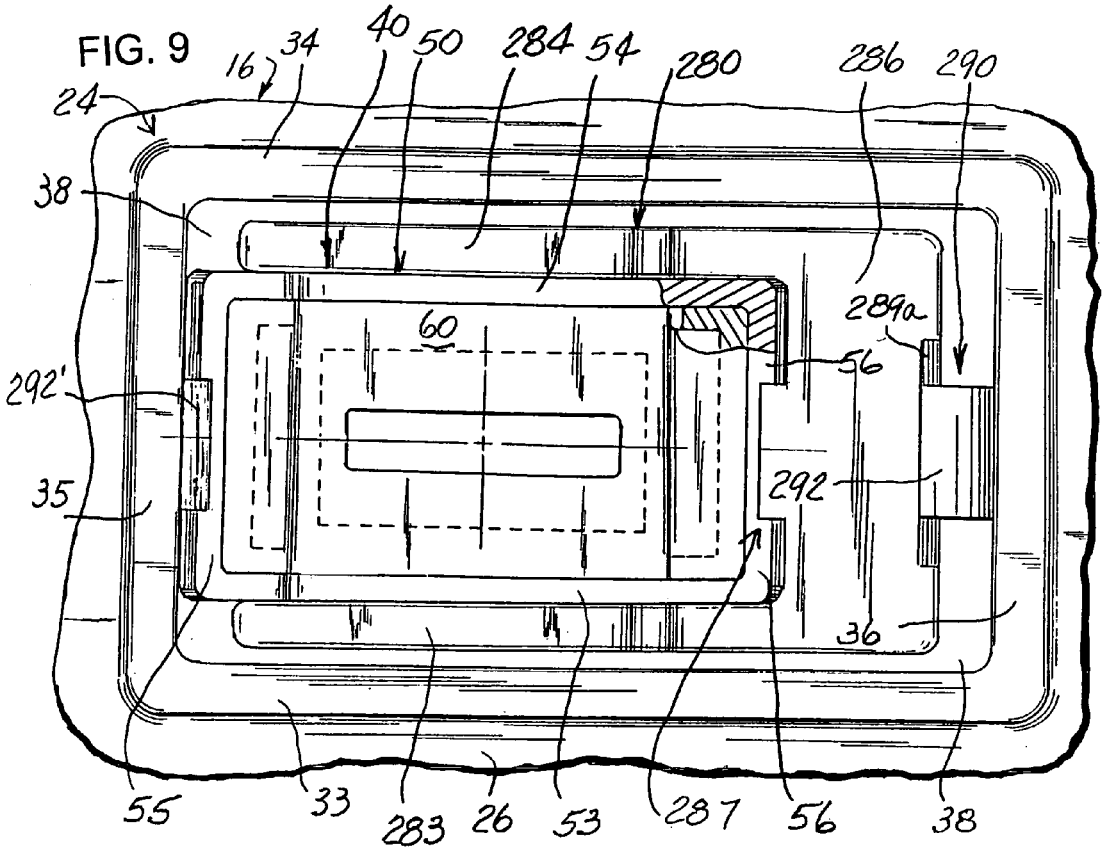
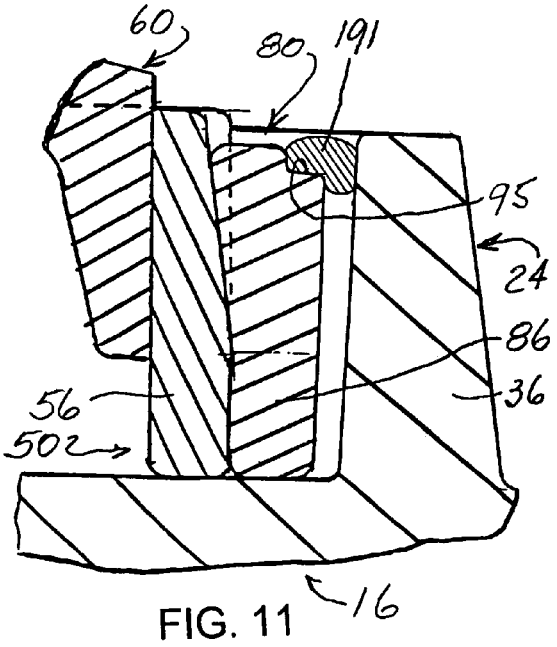
FIG. 11
FIG. 12
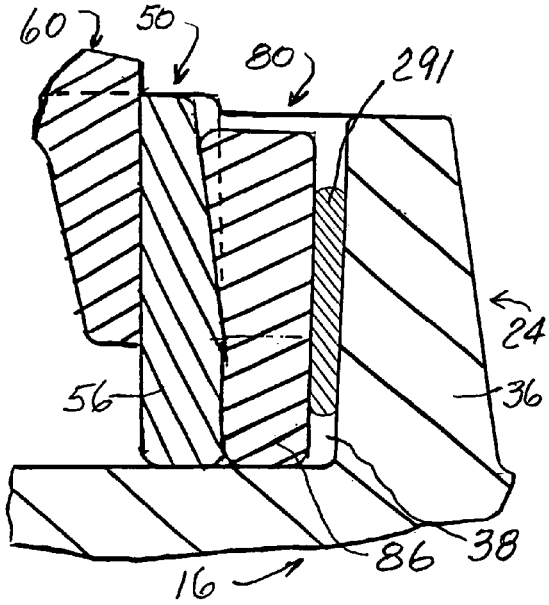

CONSTANT CONTACT SIDE BEARING ASSEMBLY FOR A RAILCAR

FIELD OF THE INVENTION

The present invention generally relates to railcars and, more particularly, to a constant contact side bearing assembly for a railcar.

BACKGROUND OF THE INVENTION

On a railcar, wheeled trucks are provided toward and support opposite ends of a railcar body for movement over tracks. Each truck is operably connected to a bolster extending transverse to the centerline of railcar for supporting the railcar body. In the preponderance of freight cars, a pivotal connection is established between the bolster and railcar body by center bearing plates and bowls transversely centered on the car body underframe and the truck bolster. Accordingly, the truck is permitted to pivot on the center bearing plate under the car body. As the railcar moves between locations, the car body tends to adversely roll from side to side.

Attempts have been made to control the adverse roll of the railcar body through use of side bearings positioned on the truck bolster laterally outwardly of the center bearing plate. In this way, the car body is supported laterally outwardly of the center plate on the bolster, while permitting relative rotation between the car body and bolster to permit normal movement of the car along the tracks. A "gap style" side bearing has been known to be used on slower moving tank/hopper railcars. Conventional "gap style" side bearings include a metal, i.e. steel, block or pad accommodated within a pocket defined on the truck bolster. An upstanding box-like open-top casing, integrally formed with or secured, as by welding or the like, to the truck bolster defines the pocket and inhibits sliding movement of the metal block relative to the bolster. The pockets provided on the bolster can, and often do, differ in size relative to each other. A gap or vertical space is usually present between the upper surface of the "gap style" side bearing and the underside of the railcar body.

Under certain dynamic conditions, combined with lateral track irregularities, the railcar truck also tends to oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and the truck. As will be appreciated, excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continues to increase. Increased rail speeds translate into corresponding increases in the amount of yaw or hunting movements of the wheeled trucks. As will be appreciated, "gap style" side bearings cannot and do not limit hunting movements of the wheeled trucks. As such, the truck components including the wheels, bolsters, and related equipment tend to experience premature wear.

In an effort to improve upon the "gap style" side bearing, and so as to enhance truck hunting stability as well as car body lateral roll stability, constant contact side bearings are known in the art and typically include a base and cap. In some side bearing designs, the side bearing base has a cup-like configuration and is suitably secured to the upper surface of the bolster by suitable fasteners extending endwise through apertured lugs radically extending outwardly from the side bearing base. The apertured lugs extending from the side bearing base inhibit mounting such side bearings within the open-top pocket on the upper surface of the railcar bolster. The side bearing cap has an upper surface which is resiliently biased to contact and rub against an underside of the car body. The side bearing cap is free to vertically move relative to the base of the side bearing. Such constant contact side bearings furthermore includes a spring.

The spring for such side bearings can comprise either spring loaded steel elements or elastomeric blocks or a combination of both operably positioned between the side bearing base and the cap. The purpose of such spring is to resiliently urge the upper surface of the cap under a preload force and into frictional contact with an underside of the car body so as to resist relative sliding movement between the underside of the car body and the bolster as well as affecting the roll motion of the car body. One such elastomeric block is marketed and sold by the Assignee of the present invention under the trade name "TecsPak."

The prior art also discloses a constant contact side bearing configured to fit or be accommodated within existing pockets on a truck bolster of a railcar. Like those mentioned above, these known constant contact side bearings include a base and a resiliently biased cap. As mentioned above, however, both the longitudinal and lateral sizes of the opening defined by the casing on the upper surface of the bolster can vary considerably between railcars. When the size of the opening or pocket defined by the casing is too large, the side bearing assembly base tends to slidably move within the pocket of the casing on the bolster thus losing or lessening the ability of the side bearing assembly to inhibit "hunting" movements.

Additionally, heat buildup in proximity to an elastomeric spring of constant contact side bearings is a serious concern. While advantageously producing an opposite torque acting to inhibit the yaw motion of the truck, the resulting friction between the side bearing and underside of the car body develops an excessive amount of heat. The repetitive cyclic compression of the elastomeric block coupled with high ambient temperatures, in which some railcars operate, further exacerbate spring deformation. As will be appreciated, such heat buildup often causes the elastomeric block to soften/deform, thus, significantly reducing the ability of the side bearing to apply a proper preload force whereby decreasing vertical suspension characteristics of the side bearing resulting in increased hunting.

Thus, there is a continuing need for a constant contact railcar side bearing assembly designed to fit within bolster pockets which are both laterally and longitudinally greater in cross-sectional size that the cross-sectional size of the side bearing assembly adapted to fit therewithin.

SUMMARY OF THE INVENTION

In view of the above, there is provided a constant contact side bearing assembly for a railcar having a bolster with an upper surface and a walled receptacle fixed to and upstanding from the upper surface of the bolster. An inner surface of the walled receptacle defines an open-top cavity wherein the side bearing assembly is accommodated. The constant contact side bearing assembly includes a spring and a base defining a recess wherein the spring is accommodated. The side bearing assembly base is configured to loosely fit or be accommodated within the open-top cavity of the walled receptacle and a gap is defined between an outer surface of the side bearing assembly base and the inner surface of the walled receptacle.

A friction member having an upper, generally flat railcar engaging surface portion, biased under the influence of said spring against an underside of said railcar, is telescopically guided by interior and upstanding wall structure on the base for vertical reciprocatory movements relative to the bolster. An adapter having at least one corner is fitted between the side bearing assembly base and the walled receptacle to, at least partially, fill the gap between the side bearing assembly base and the interior surface of the walled receptacle thereby positively positioning, both laterally and longitudinally, the side bearing assembly while reducing horizontal shifting movements side bearing assembly relative to the bolster.

Preferably, the bearing assembly further includes an apparatus for operably securing the adapter to the walled receptacle. In one form, such apparatus includes a weld between the adapter and the walled receptacle at a location avoiding interference with the underside of the car body. In another form, such apparatus includes one or more shims disposed between the adapter and the walled receptacle, with the one or more shims being operably coupled to at least one of the adapter and the walled receptacle. In still another embodiment, the outer surface of the adapter and the inner surface of the walled receptacle define generally upstanding vertical confronting surfaces. In this embodiment, the engaging apparatus for securing the adapter to the walled receptacle includes cooperating instrumentalities disposed between the confronting surfaces for securing the adapter and walled receptacle in generally fixed relation relative to each other.

Preferably, the side bearing assembly further includes an apparatus for operably securing the side bearing assembly and adapter in operable combination relative to each other. In one form, such apparatus includes cooperating instrumentalities between the side bearing assembly base and adapter for operably securing the side bearing assembly and adapter in operable combination relative to each other.

According to another aspect, there is provided a constant contact side bearing assembly for a railcar having a bolster extending transversely relative to a longitudinal axis of the railcar. A rectangular open-top casing upwardly projects from an upper surface of the bolster. Such casing has a pair of transversely spaced generally parallel side walls and a pair of longitudinally spaced end walls. The constant contact side bearing assembly includes a base defining a recess between two transversely spaced sides rigidly joined to two longitudinally spaced and upstanding ends. The spacing between the sides and ends of the base is less than the spacing between the sidewalls and end walls of the open-top casing on the bolster such that the side bearing assembly base is loosely arranged within the casing and a gap is provided between an outer surface on the sides and ends of the base relative to an inner surface on the sidewalls and end walls of the casing. The side bearing assembly further includes a cap having an upper friction engaging surface for the side bearing assembly along with structure depending from the friction engaging surface. The depending structure on the cap is telescopically guided by the upstanding ends of the base. Moreover, a resilient member, arranged within the recess defined by side bearing assembly base, is operable to urge the friction engaging surface of the cap into frictional sliding contact with an underside of the railcar. An adapter having at least one corner is fitted within and, at least partially fills the gap between the outer surface of the side bearing assembly base and the inner surface of the casing thereby positively positioning, both longitudinally and laterally, the side bearing assembly base relative to the casing while inhibiting horizontal shifting of the side bearing assembly base relative to the bolster.

In one form, the resilient member of the side bearing assembly includes an elastomeric spring. To enhance the strength thereof, the side bearing assembly base is preferably formed from austempered ductile iron material.

Preferably, the constant contact side bearing assembly further includes an apparatus for operably securing the adapter to the casing. In one form, such apparatus includes welding the adapter and walled casing to each other at a location avoiding interference with the underside of the railcar. In another embodiment, the apparatus for operably securing the adapter to the walled casing includes one or more shims disposed between the adapter and casing. In still another embodiment, an outer surface of the adapter and the inner surface of the casing define generally upstanding vertical confronting surfaces, and wherein the apparatus for operably securing the adapter to the casing includes cooperating instrumentalities disposed between the confronting surfaces for securing the adapter and walled casing in generally fixed relation relative to each other after the adapter is fitted about the base of the side bearing assembly.

Preferably, the constant contact side bearing assembly further includes an apparatus for operably connecting the adapter and side bearing assembly base in operable combination relative to each other after the adapter is positioned about the side bearing assembly base. In one form, such an apparatus includes cooperating instrumentalities between the side bearing assembly base and adapter for inhibiting shifting movements of the base and adapter relative to each other.

In one embodiment, the adapter has a generally L-shaped configuration, with one leg of the adapter being configured to extend between the sidewall of the walled casing and a side of the side bearing assembly base and a second leg extending between an end wall of the casing and an end of the side bearing assembly base. Alternatively, the adapter is comprised of two pieces, with one piece fitting between one end of the side bearing assembly base and one end wall of the casing and a second piece fitting between a second end of the side bearing assembly base and a second end wall of the casing.

In yet another form, the adapter has two sides and two ends rigidly joined to each other in a generally rectangular configuration. In this form, each end of the side bearing assembly base and each end of the adapter define a pair of upstanding confronting surfaces. At least a vertical portion of the confronting surfaces between each end of the side bearing assembly base and each end of the adapter is configured at substantially similar vertically inclined angles such that an inclined surface portion on said the operably engages with a substantially similar inclined surface portion on the adapter whereby inhibiting shifting movements of the side bearing assembly relative to the bolster after the adapter is positioned about the base.

According to another aspect, there is provided a constant contact side bearing assembly for a railcar having a bolster transversely extending relative to a longitudinal axis of the railcar. A rectangular open-top casing upwardly projects from an upper surface of the bolster and has a pair of transversely spaced generally parallel sidewalls and a pair of longitudinally spaced end walls. The constant contact side bearing assembly includes a spring accommodated within a recess defined by a generally rectangularly shaped base of the side bearing assembly. The side bearing assembly base has two transversely spaced sides joined to two longitudinally spaced upstanding ends. The transverse spacing between the sides and the longitudinal spacing between the ends of the side bearing assembly base are less than the transverse spacing between the sidewalls and the longitudinal spacing between the end walls of the casing such that a gap is provided between the exterior of the side bearing assembly base and an interior of the rectangular casing after the side bearing assembly is arranged in operable combination therewith. A cap is vertically positioned by and overlies the spring. The cap includes a generally flat surface with a pair of longitudinally spaced ends depending therefrom. The longitudinal spacing between an outer surface on the ends of the cap is generally equal to the longitudinal spacing between inner surfaces on the longitudinally spaced upstanding ends of the base such that, when the cap and base are assembled, the cap slidably moves along and is guided by the inner surfaces of the upstanding ends of the base for vertical movements of the cap relative to the base while preventing substantial longitudinal shifting movements of the relative to the side bearing assembly base. An adapter defining at least one interior corner is configured to fit within and fill the gap between the outer surface of the side bearing assembly base and the inner surface of the casing.

The side bearing assembly base is preferably formed from an austempered ductile iron material. Moreover, the side bearing assembly preferably includes an apparatus for inhibiting longitudinal shifting movement of the adapter relative to the casing after side bearing assembly is arranged in operable combination with the casing and the adapter is fitted about the side bearing assembly base.

In one form, the apparatus for inhibiting longitudinal shifting movement of the adapter relative to the walled casing includes a weld between the adapter and the casing at a location to avoid interference with the underside of the railcar. Alternatively, the apparatus for inhibiting longitudinal shifting movement of the adapter relative to the casing includes one or more shims disposed between the adapter and the casing, with one or more of the shims being operably coupled to at least one of the adapter and casing.

In another embodiment, the outer surface of the adapter and the inner surface of the casing define generally upstanding vertical confronting surfaces. In this form, the apparatus for inhibiting longitudinal shifting movement of the adapter relative to the casing includes cooperating instrumentalities disposed between the confronting surfaces for securing the adapter and casing in generally fixed relation relative to each other after the adapter is fitted about the side bearing assembly base.

Preferably, the side bearing assembly further includes an apparatus for inhabiting longitudinal shifting movements of the side bearing assembly base and adapter relative to each other. In one form, the apparatus for inhibiting longitudinal shifting movements of the side bearing base and adapter relative to each other includes cooperating instrumentalities disposed between at least one end of the side bearing assembly base and an end of the adapter.

In one form, the adapter has a generally L-shaped configuration. One leg of the adapter extends between the sidewall of the casing and a side of the side bearing assembly base and a second leg extends between the end wall of the casing and an end of the side bearing assembly base. In another form, the adapter includes two similar pieces. One piece of the adapter is configured to fit between one end of the side bearing assembly base and one end wall of the casing and a second piece fits between a second end of the side bearing assembly base and a second end wall of the casing.

In another form, the adapter has two sides and two ends rigidly joined to each other in a generally rectangular configuration. In this embodiment, each end of the side bearing assembly base and each end of the adapter define a pair of upstanding confronting surfaces. At least a vertical portion of the confronting surfaces between each end of the base and each end of the adapter is configured at substantially similar vertically inclined angles such that an inclined surface portion on the base operably engages with a substantially similar inclined surface portion on the adapter whereby inhibiting shifting movements therebetween after the adapter is positioned about the side bearing assembly base and is secured to the casing.

One feature of the present invention relates to providing a constant contact side bearing assembly which is adaptable to existing bolster pockets of different sizes.

Another feature of the invention relates to providing a constant contact side bearing assembly configured for securement within a railcar bolster pocket having a cross-section considerably greater than a cross-section of the side bearing assembly.

Another feature of the invention relates to providing a constant contact side railcar side bearing assembly including an adapter for optimizing performance of the side bearing assembly when fitted within a bolster pocket on a railcar.

Yet another feature of the present invention relates to providing a railcar side bearing assembly employing an elastomeric block as the cushioning medium and which is structured to dissipate heat from the side bearing assembly during operation.

These and additional features, aims and advantages of the present invention will become more readily apparent from the drawings, description of the invention, and the appended claims.

BRIEF DESCRIPTION OF THE DRAWINGS

FIG. 5 is an enlarged left top perspective view of one form of adapter used in combination with the invention;

FIG. 6 is an enlarged view of that area encircled in FIG. 2 showing one embodiment of an apparatus for securing the side bearing assembly and adapter to a walled receptacle on a railcar bolster;

FIG. 7 is a view similar to FIG. 6 but showing an alternative embodiment of an apparatus for securing the side bearing assembly and adapter to a walled receptacle on a railcar bolster;

FIG. 8 is a top plan view similar to FIG. 3 showing an alternative form of the present invention;

FIG. 9 is a top plan view similar to FIG. 3 showing another alternative form of the present invention;

FIG. 11 is a view similar to FIG. 6 but showing yet another alternative embodiment of an apparatus for securing the side bearing assembly and adapter to a walled receptacle on a railcar bolster;

FIG. 12 is a view similar to FIG. 6 showing still another alternative embodiment of an apparatus for securing the side bearing assembly and adapter to a walled receptacle on a railcar bolster.

DETAILED DESCRIPTION OF THE INVENTION

Figure 1:
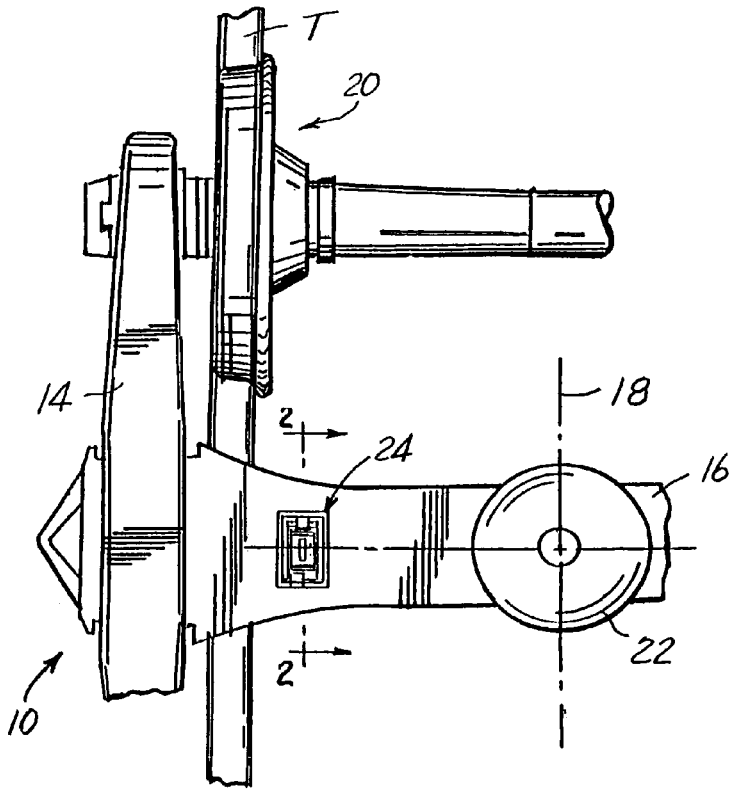
FIG. 1 is a top plan view of a portion of a railcar wheeled truck including a side bearing assembly embodying principals of the present invention.

While the present invention is susceptible of embodiment in multiple forms, there is shown in the drawings and will be described a preferred embodiment of the invention, with the understanding the present disclosure sets forth an exemplification of the invention which is not intended to limit the invention to the specific embodiment illustrated and described.

Referring now to the drawings, wherein like reference numerals indicate like parts throughout the several views, there is shown in FIG. 1 a fragment of a railcar wheeled truck assembly, generally indicated by reference numeral 10, which supports and allows a railcar body 12 (FIG. 2) to ride along and over tracks T. Truck assembly 10 is of a conventional design and includes a side frame 14, a bolster 16, extending generally transversely relative to a longitudinal centerline 18 of the railcar 12 and a wheel set 20. A conventional center bearing plate 22 is suitably mounted on the bolster 16 for pivotally supporting one end of the car body 12.

On opposite lateral sides of the bearing plate 22, the bolster 16 of the illustrated truck assembly has a conventional casing or housing 24 (with only one casing being shown). Each casing 24 on bolster 16 is either formed integral with or is secured, as by welding or the like, to project upwardly from an upper bolster surface 26 and can take different forms. In the version illustrated in FIG. 3, casing 24 includes a pair of generally parallel and laterally spaced vertical side walls 33 and 34 and a pair of generally parallel and longitudinally spaced end walls 35 and 36. Each upper end or extremes of the walls 33, 34, 35 and 36 terminates in a generally planar relationship relative to the other walls a predetermined distance above the upper bolster surface 26. Moreover, and in the form shown, the wall structure 33, 34, 35 and 36 on casing 24 presents on its upper surface an open-top box-like structure or pocket 38.

Figure 2:
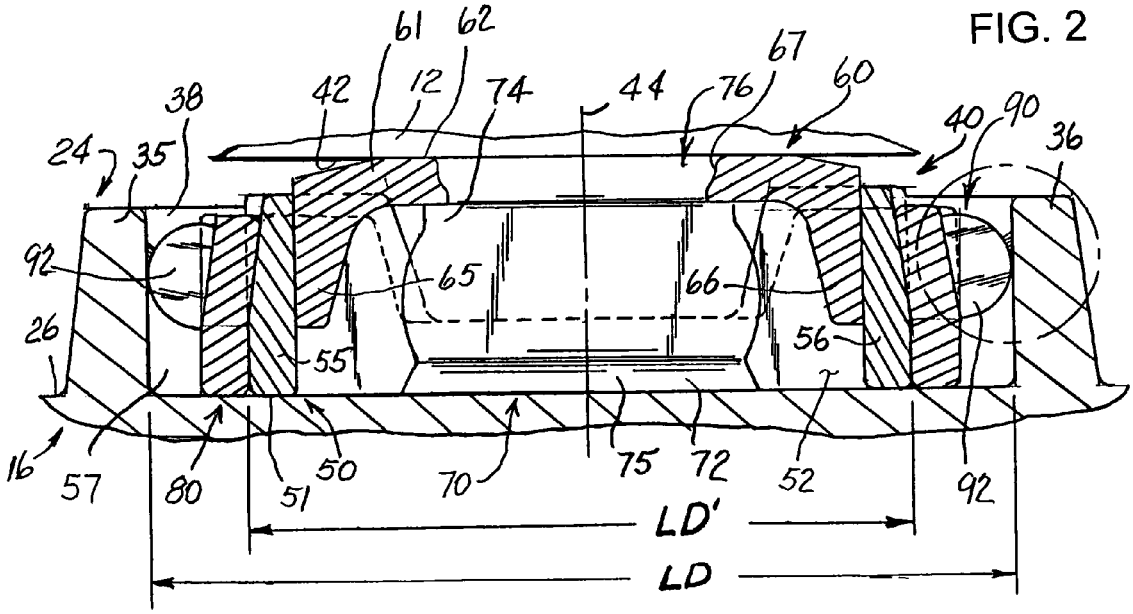
FIG. 2 is a longitudinal sectional view taken along line 2-2 of FIG. 1.
Figure 4:
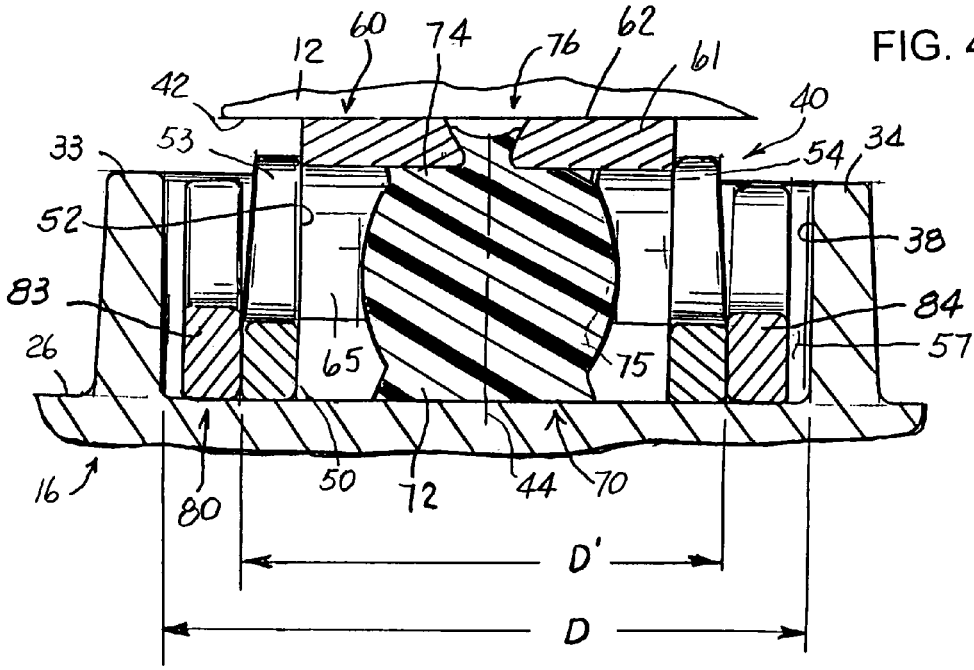
FIG. 4 is a sectional view taken along line 4-4 of FIG. 3.

The end walls 35, 36 of casing 24 are typically spaced apart a further distance than are the side walls 33, 34 such that the closed margin of pocket 38 is generally rectangular; with a length thereof extending generally longitudinally and generally parallel to the railcar axis 18 (FIG. 1). As shown in FIG. 2, interior surfaces of the end walls 35, 36 of casing 24 are spaced apart by a predetermined longitudinal distance LD. As shown in FIG. 4, interior surfaces of the side walls 33, 34 of casing 24 are spaced apart by a predetermined lateral distance D. Both the longitudinal distance LD and lateral distance D defined by each opening or pocket 38 can vary between railcars. Suffice it to say, the elements and structures set forth above are well known in the art and further description of such elements and structures will not be further set forth except where necessary for a complete understanding of the present invention.

According to the invention, a constant contact side bearing assembly 40 is configured to be accommodated within the pocket or recess 38 defined by each casing 24 on the bolster 16 for supporting and frictionally engaging an underside 42 of the railcar body 12. As shown in FIGS. 2 and 4, bearing assembly 40 defines an axis 44 extending generally normal to the upper bolster surface 26 after assembly 40 is arranged in operable combination with the bolster 16.

The side bearing assembly 40 illustrated for exemplary purposes is specifically designed with a low profile. It should be appreciated, however, the principals of this invention equally apply to railcar side bearings configured to operate in combination with railcars having a standard nominal working space of about five and one-sixteenth inch between the truck bolster and the car body underside. Suffice it to say, bearing assembly 40 preferably includes a multipiece assembly including a housing or base 50 and a cap or friction member 60 arranged for guided movements relative to the housing 50. A resilient member or spring 70 is arranged in operable combination with and positions cap 60 relative to the upper bolster surface 26.

Figure 3:
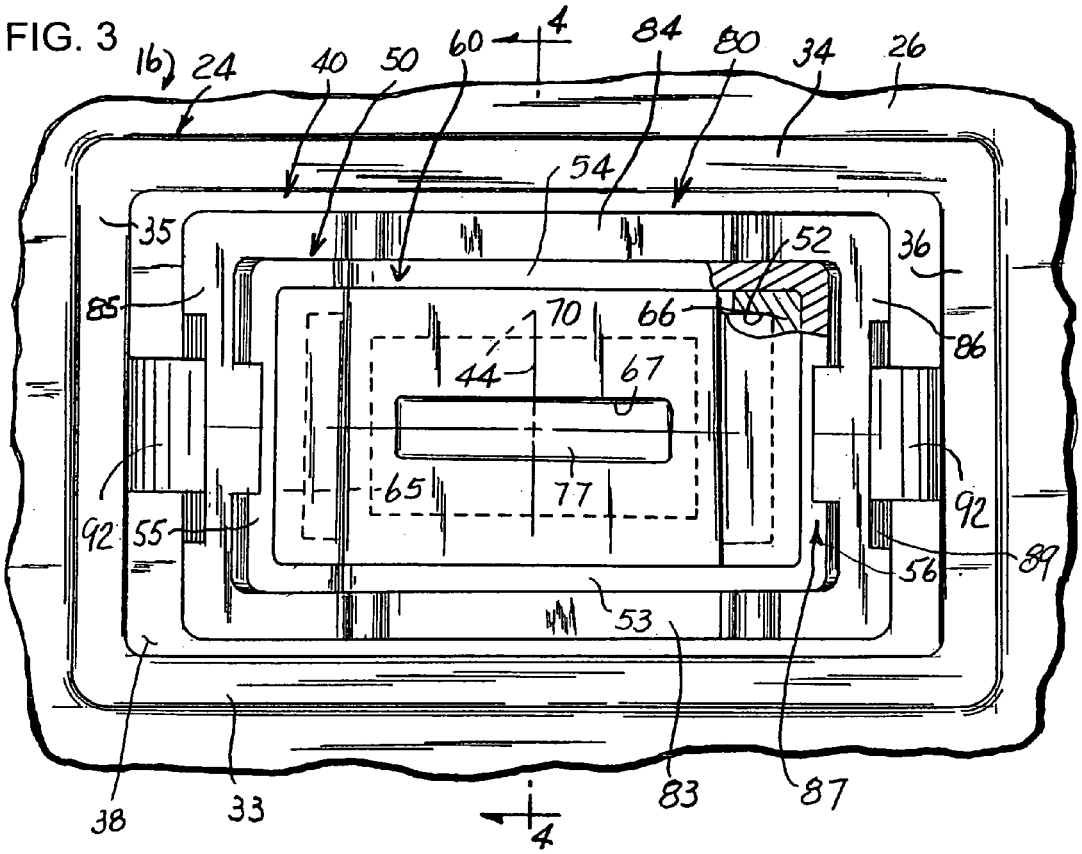
FIG. 3 is an enlarged top plan view of one embodiment of the present invention.

The side bearing assembly housing or base 50 is formed from metal. In a preferred embodiment, the side bearing assembly housing or base 50 is formed from austempered ductile iron and, as illustrated in FIG. 3, has walls or upstanding wall structure. Returning to FIG. 2, the bearing housing 50 preferably extends about the spring 70 and defines a cavity 52 for accommodating the spring 70. In one form, the recess or cavity 52 extends through housing 50 and is open at opposite ends. In the illustrated embodiment, the marginal edge of cavity 52 has a generally rectangular profile. As shown, bearing housing 50 includes pair of generally parallel and spaced vertical sides 53 and 54 (FIG. 4) disposed to opposed lateral sides of the bearing assembly axis 44 and a pair of generally parallel and spaced ends 55 and 56 (FIG. 2) joined to the sides 53, 54 and disposed to opposed longitudinal sides of the bearing assembly axis 44. In a preferred embodiment, the upper extreme edges of the walls 53, 54, 55 and 56 of bearing housing 50 are arranged in generally coplanar relation relative to each other.

As shown in FIG. 2, the longitudinal distance LD' between the outer surfaces of the ends 55, 56 of the side bearing housing 50 is less than the longitudinal distance LD between the interior surfaces of the end walls 35, 36 of the casing 24. As such, and after the side bearing assembly housing 50 is accommodated in the pocket 38 of casing 24 a gap or opening 57 exists between one or both of the outer surfaces of the side bearing housing ends 55, 56 and the interior surfaces of the end walls 35, 36 of the casing 24. Moreover, and as shown in FIG. 4, the lateral distance D' between the outer surfaces of the sides 53, 54 of the side bearing housing 50 is less than the lateral distance D between the interior surfaces of the sidewalls 33, 34 of the casing 24. As such, and after the side bearing assembly housing 50 is accommodated in the pocket 38 of casing 24, a gap or opening 57' exists between one or both of the outer surfaces of the side bearing housing sides 53, 54 and the interior surfaces of the sidewalls 33, 34 of the casing 24.

When initially inserted into bolster casing 24, bearing housing 50 is accommodated within pocket 38 in a loose or non-restrained fashion. As such, and in those embodiments wherein the recess or opening 52 extends through the housing 50, a lower end or bottom 51 of the bearing housing 50 sits on or engages the upper bolster surface 26. With the side bearing assembly design shown in FIGS. 3 and 4, and with the lower extreme or bottom 51 of bearing housing 50 engaging bolster surface 26, the upper ends of the walls 53, 54, 55 and 56 terminate a predetermined distance above the upper extreme edge of the bolster casing 24.

The cap or friction member 60 is also preferably formed from metal. Cap 60 overlies and transmits loads to the spring 70 during operation of the bearing assembly 40. As illustrated in FIGS. 2 and 4, cap 60 has a top plate 61 defining a generally flat surface 62 adapted to frictionally engage and establish metal-to-metal sliding contact with the car body underside 42. In the illustrated embodiment, cap 60 includes walls or wall structure depending from and preferably formed integral with the top plate 61. In one form, the depending wall structure on cap 60 is arranged to the interior of and cooperates with the upstanding wall structure on housing 50 to guide cap 60 for generally coaxial or telescopic movements relative to housing 50.

In the embodiment illustrated in FIGS. 2, 3 and 4, the depending wall structure on cap 60 is comprised of a pair of longitudinally spaced ends 65 and 66 which are connected to and depend from the top plate 61. In a preferred embodiment, cap 60 defines openings along opposed sides thereof and extending between the ends 65 and 66. Suffice it to say, the depending wall structure on cap 60, including the ends 65 and 66, is configured to complement and operably cooperate with the interior marginal edge surrounding the cavity 52 defined by bearing housing 50 whereby inhibiting horizontal shifting movements of the cap 60 relative thereto. As shown, and when spring 70 is arranged in operable combination with the assembly 40, the free or terminal ends of the ends 65 and 66 of cap 60 are vertically spaced from the upper bolster surface 26 a greater distance than is vertically measurable between the underside 42 of the car body 12 and the upper extreme ends of the wall structure of bearing housing 50.

The purpose of spring 70 is to position the side bearing cap 60 relative to the bolster 16 and to develop a predetermined preload or suspension force thereby urging cap plate 61 toward and into substantially constant friction engagement with the underside 42 of the car body 16. The preload or suspension force developed by spring 70 allows the side bearing assembly 40 to absorb forces imparted thereto when the car body 12 tends to roll and furthermore inhibits hunting movements of the wheeled truck assembly 12 relative to the car body 12. Suffice it to say, spring 70 is designed to develop a preload force ranging between about 7,000 and about 9,000 pounds.

As will be appreciated, the shape of spring 70 can vary from that illustrated for exemplary purposes without detracting or departing from the spirit and scope of the invention. Moreover, spring 70 can be formed from a myriad of different materials without detracting or departing from the invention. That is, spring 70 can be formed from either spring loaded steel elements or elastomeric blocks or a combination of both. In the exemplary embodiment, a substantial portion of spring 70 is disposed within the cavity 52 defined by bearing housing 50 and is configured for placement between bolster surface 26 and an underside of the top plate 61 on the side bearing cap 60. Spring 70 includes a first end 72 which, in one form of the side bearing assembly, is adapted to abut and directly engage that portion of the bolster surface 28, defined within parameters defined by the walled casing 24, and an axially spaced second end 74.

Spring 70 preferably includes a formed, resiliently deformable block or column of thermoplastic elastomeric material 75 having a predetermined length and a predetermined cross-sectional shape capable of developing the required preload force for the side bearing assembly 40. Preferably, the spring block or column 75 is formed from a copolyesther polymer elastomer of the type manufactured and sold by the DuPont Company under the tradename HYTREL. Ordinarily, a HYTREL elastomer has inherent physical properties which make it unsuitable for use as a spring. Applicants' assignee, however, has advantageously discovered it is possible to impart spring-like characteristics to a HYTREL elastomer. Coassigned U.S. Pat. No. 4,198,037 to D. G. Anderson better describes the above noted polymer material and forming process and is herein incorporated by reference. When used as a spring, the thermoplastic material forming spring 70 has an elastic strain to plastic strain ratio greater than 1.5 to 1.

In the illustrated embodiment, the bearing cap 60 and spring 70 are cooperatively designed and configured to be interlocked relative to each other. Preferably, the generally flat railcar engaging surface portion 61 of the bearing cap 60 and the second end 74 of spring 70 have interlocking instrumentalities, generally identified by reference numeral 76, for securing the spring 70 and bearing cap 60 in operable combination relative to each other. As will be appreciated, by securing cap 60 and spring 70 in operable combination, such an arrangement likewise positions the spring 70 relative to the housing 50 of the side bearing assembly 40.

The interlocking instrumentalities 76 between cap 60 and spring 70 can take a myriad of different types for achieving the desired ends. As shown in FIGS. 2 through 4, plate 61 of cap 60 preferably defines a generally centralized throughbore 67. Preferably, spring 70 is formed with a projection 77 sized to be accommodated and captured within opening 67 in the bearing cap 60. The opposed ends and sides of opening 67 serve as stops for limiting displacement of the spring 70 relative to the cap 60 during operation of the side bearing assembly 40.

To facilitate lateral and longitudinal positioning of the side bearing assembly 40 within the casing 24 while inhibiting horizontal shifting of the side bearing assembly 40 relative to the bolster 16 so as to optimize side bearing assembly performance, the side bearing assembly 40 furthermore includes a rigid multisided adapter 80 configured to fit between the outer surface of the side bearing base 50 and the inner surface of the walled casing 24 so as to at least partially fill the gaps or openings 57 and 57' therebetween. With the multisided adapter 80 at least partially filling the spaces 57 and 57', horizontal shifting movements of the bearing assembly 40 is limited thereby optimizing the ability of the side bearing assembly 40 to limit "hunting" movements of the bolster 16 during railcar operations.

Adapter 80 can have multiple configurations without detracting or departing from the principals of this invention. In one form, adapter 80 is formed from metal and has a predetermined rectangular configuration sized relative to the side bearing assembly base 50. The multisided adapter 80 shown in FIGS. 3 and 5 is formed by a pair of laterally spaced and vertically upstanding sides 83, 84 rigidly connected to a pair of longitudinally spaced and vertically upstanding ends 85, 86. The adapter sides 83, 84 substantially parallel the sides 53, 54 of side bearing assembly base 59 while the adapter ends 85, 86 substantially parallel the side bearing assembly base ends 55, 56. In a preferred embodiment, the upper extreme edges of the sides 83, 84 and ends 85, 86 of adapter 80 are arranged in generally coplanar relation relative to each other. Moreover, the upper ends of the sides 83, 84 and ends 85, 86 of adapter 80 preferably terminate a predetermined distance below the upper extreme edge of the side bearing base 50.

Interior surfaces of the vertically upstanding adapter sides 83, 84 are separated by a lateral distance only slightly greater than the predetermined lateral distance D' separating the outer or exterior surfaces of the sides 53, 54 of the side bearing assembly base 50. Similarly, and as shown in FIG. 2, interior surfaces of the vertically upstanding adapter ends 85, 86 are separated by a longitudinal distance only slightly greater than the predetermined longitudinal distance LD' separating the outer or exterior surfaces of the ends 55, 56 of the side bearing assembly base 50. As such, the multisided adapter 80 preferably fits about the exterior of the side bearing base 50 with only restricted lateral and longitudinal shifting movements being permitted therebetween.

The sides 83, 84 and ends 85, 86 of adapter 80 are joined or connected such that a corner, defining an included angle of about 90°, is provided at the conjuncture of each side and each end. Notably, the cumulative thickness of the sides 83, 84 of adapter 80 is about equal to or less than the difference between the distances D and D' of casing 24 and side bearing assembly 40, respectively. Moreover, the cumulative thickness of the ends 85, 86 of adapter 80 is about equal to or less than the difference between the distances LD and LD' of casing 24 and the side bearing assembly 40, respectively.

Besides being configured to fit about the side bearing assembly base 50, in a preferred form, the side bearing assembly base 50 and adapter 80 are operably connected to each other. In one form, the side bearing assembly base 50 and adapter 80 define cooperating instrumentalities, generally identified in FIG. 3 by reference numeral 87, for operably connecting the base 50 and adapter 80 in operable combination relative to each other. The cooperating instrumentalities 87 for operably connecting the side bearing assembly base 50 and adapter 80 can take a myriad of different forms including welding the side bearing assembly base 50 to the adapter 80 and other mechanical fastening devices. Since the side bearing assembly base 50 is preferably formed from austempetred ductile iron, however, the methodology used to effect the operable coupling therebetween can present certain design challenges.

After adapter 80 is positioned about the side bearing assembly base 50 and arranged within the walled casing 24, the relationship between the ends 85, 86 of the adapter 80 relative to the ends 55, 56 of the side bearing base 50 and the end walls 35, 36 of the walled casing 24 are substantially similar. Accordingly, only the relationship between end 86 of adapter 80 relative to the end 56 of the side bearing base 50 and the end wall 36 of the walled casing 24 will be discussed in detail with the understanding a substantially similar arrangement between adapter 80, side bearing assembly base 50 and the walled casing 24 is provided at the opposite end.

After adapter 80 is positioned about the side bearing assembly base 50, the adapter end 86 and the outer surface of the upstanding side bearing assembly base end 56 are arranged in generally confronting relation relative to each other. One embodiment of the cooperating instrumentalities 87 used to operably connect the base 50 and adapter 80 is shown in FIG. 6. The cooperating instrumentalities 87, shown by way of example in FIG. 6, includes configuring the upstanding side bearing assembly base end 56 with a recess 58 laterally extending for at least a portion or the full width of base end 56 and vertically extending for a portion of or for the full height of base end 56 and opening to the top and exterior side of the base end 56. Recess 58 preferably includes an inclined surface portion 59 vertically slanting toward the vertical axis 44 (FIG. 2) of the bearing assembly 40.

The cooperating instrumentalities 87 shown in FIG. 6, further includes a projection 88 provided on an inner surface of the end 86 of the adapter 80. In one form, the projection 88 is formed integral with the inner surface of the end 86 of the adapter 80 and is preferably configured to complement and be accommodated or received within the recess 58 defined by the side bearing assembly base end 56 after adapter 80 is arranged in operable combination with the side bearing assembly base 50. Preferably, projection 88 has a surface portion 89 with a similar slant or incline to and extending longitudinally toward the confronting inclined surface portion 59 on the end 56 of the side bearing assembly base 50. When the recess 58 on the end 56 of the side bearing assembly base 50 and projection 88 on the end 86 of adapter 80 are arranged in assembled order relative to each other, the vertically slanted surfaces 59 and 89 on side bearing assembly base 50 and adapter 80, respectively, cooperate relative to each other and serve to limit vertical movement of the side bearing assembly base 50 relative to the adapter 80. Of course, the design of the cooperating instrumentalities 87 can be either altered or reversed without adversely affecting the performance of the operable relation between base 50 and the multisided adapter 80.

As mentioned, the apparatus for operably securing the side bearing base 50 and adapter 80 in operable combination relative to each other can take different forms. In this regard, an alternative form of apparatus for connecting the side bearing base 50 and adapter 80 in operable combination relative to each other is shown in FIG. 7. This alternative apparatus for connecting the side bearing base 50 and adapter 80 in operable combination relative to each other is generally identified by reference numeral 87'. The elements of the side bearing base and adapter shown in FIG. 7 that are analogous to those components of the side bearing base and adapter discussed above are designated by reference numerals identical to those listed above.

Like above, and after adapter 80 is positioned about the side bearing assembly base 50 within the walled casing 24, the relationship between the ends 85, 86 of the adapter 80 relative to the ends 55, 56 of the side bearing base 50 and the end walls 35, 36 of the walled casing 24 are substantially similar. Accordingly, only the relationship between end 86 of adapter 80 relative to the end 56 of the side bearing base 50 and the end wall 36 of the walled casing 24 will be discussed in detail with the understanding a substantially similar arrangement between adapter 80, the side bearing assembly base 50, and the walled casing 24 is provided at the opposite end.

Like above, an exterior surface of each end of side bearing assembly base 50 is provided with a recess 58 laterally extending for at least a portion or the full width of base end 56 and vertically extending for a vertical portion of or for the full height of base end 56 and opening to the top and exterior of base end 56. Recess 58 preferably includes an inclined surface portion 59 vertically slanting toward axis 44 (FIG. 2) of bearing assembly 40. In the alternative form, shown by way of example in FIG. 7, the interior surface configuration of the adapter end 86 is preferably configured with a recess 88' laterally extending for at least a portion or the full width of adapter end 86 and vertically extending for a portion of or for the full height of adapter end 86 and opening to the top edge of the adapter end 86. Recess 88' preferably includes an inclined surface portion 89' vertically slanting away from the vertically inclined surface portion 59 on the side bearing assembly base 50 so as to define an open-top, generally V-shaped opening 89". The open-top and generally V-shaped opening 89" is configured to facilitate accommodation of cooperating instrumentalities in the form of a locking insert or spacer 92' positioned within opening 89". Spacer 92' preferably has a generally wedge shape. A similar locking insert or shim is preferably used at the opposite end of the side bearing assembly for enhancing the securement of the side bearing assembly base 50 and to the casing 24. In the embodiment shown in FIG. 7, and after being inserted within opening 89" and operably engaged with the slanted surfaces 59 and 89' on the side bearing base 50 and adapter 80, respectively, each insert or shim is welded in place to inhibit inadvertent separation from the opening 89".

When an alternative apparatus like that shown by way of example in FIG. 7 is used to operably secure the side bearing base 50 and adapter 80 in operable combination, interior surfaces of the vertically upstanding adapter ends 85, 86 can be longitudinally spaced apart by a distance greater than the predetermined distance separating the exterior surfaces of the vertically upstanding ends 55, 56 of the side bearing base 50 without detracting from the holding capacity and positioning accuracy provided by apparatus 87'. Whereas, and as will be appreciated by those skilled in the art, having some longitudinal separation between the exterior surfaces of the vertically upstanding ends 55, 56 of the side bearing assembly base 50 and the interior surfaces of the vertically upstanding adapter ends 85, 86 only enhances the ability of each shim or spacer 92, 92' to properly seat between the respective surfaces on the side bearing assembly base 50 and adapter 80 to enhance the holding capacity and positioning accuracy provided by apparatus 87'.

Preferably, and after side bearing assembly 40 is accommodated in pocket 38 of walled housing 24, and regardless of which apparatus is used operably secure the side bearing base 50 and adapter 80 in operable combination, a securement apparatus, generally indicated by reference numeral 90, operably secures adapter 80 to the walled casing 24 thereby positively securing and positioning side bearing assembly 40 relative to the truck bolster 16.

As shown in FIG. 2, and because of variances in the size of bolster pockets, after bearing assembly 40 is accommodated within the walled casing 24, the end walls 35, 36 of casing 24 and the ends 85, 86 of adapter 80 are arranged in confronting and generally parallel but can be longitudinally spaced from each other. That is, and depending upon the particular size of the pocket 38 in the bolster casing 24, even after adapter 80 is fitted about the base 50 of the side bearing assembly, the confronting end walls 35, 36 of casing 24 and ends 85, 86 of adapter 80 can be longitudinally separated. In one form, the securement apparatus 90 allows for securing adapter 80 of the side bearing assembly within bolster pockets 38 of varying sizes, thus, adding versatility to side bearing assembly 40.

Since the relationship between the end walls 35, 36 casing 24 and ends 85, 86 of adapter 80 are substantially similar, only the relationship of the securement apparatus 90 with the end wall 36 of casing 24 and the end 86 of adapter 80 will be discussed in detail. In that form shown in FIG. 6, securement apparatus 90 includes cooperating instrumentalities 91 for securing adapter 80 of the side bearing assembly within the bolster pocket 38. The cooperating instrumentalities 91 of securement apparatus 90, shown by way of example in FIGS. 2, 3 and 6, includes a locking insert or spacer 92 installed and, preferably, snugly inserted between the confronting walls 36 and 86, respectively, of the walled casing 24 and adapter 80. In the illustrated embodiment, the locking inserts or spacers 92, at opposed ends of the adapter 80, fits and/or wedges within the longitudinal spacing or gap remaining in the pocket 38 between the exterior surface on the ends 85, 86 of the adapter 80 and the interior surfaces of the end walls 35, 36 of the casing 24. Thereafter, each locking insert or shim spacer 92 is fastened or secured, as by welding or other suitable mechanical device, preferably to an exterior surface of an adjacent end wall of the walled casing 24 to inhibit longitudinal shifting movements of the bearing assembly 40 relative to the bolster 16.

As illustrated in FIGS. 2 and 3, each respective pair of confronting walls 35, 85 and 36, 86 on the walled casing 24 and adapter 80, disposed to opposed longitudinal sides of the bearing assembly axis 44 is preferably configured to further enhance securement of the bearing assembly 40 relative to the bolster 16. Since the relationship between the end walls 35, 36 of the casing 24 relative to the ends 85, 86 of the adapter 80 are substantially similar, only the relationship between end wall 36 of the casing 24 and the end 86 of adapter 80 will be discussed in detail.

In the form shown in FIG. 6, at least a portion of one of the confronting surfaces of the casing end wall 36 and adapter end 86 is configured with a vertically inclined or slanted surface portion 89*a*. The vertically inclined surface portion 89*a* on at least one of the confronting surfaces of the casing end wall 36 and adapter end 86 creates a generally V-shaped open-top channel or void 94 between the exterior surface of the casing end wall 36 and adapter end 86. That is, the channel or void 94 between the confronting surfaces on the casing end wall 36 and adapter end 86 preferably increases from bottom to top and has a generally wedge-shape. As will be appreciated, the preferable wedge-shape of the opening 94 enhances reception and retention of the locking insert or spacer 92 therewithin. Preferably, the spacer 92 has a generally wedge shape. In the embodiment illustrated in FIG. 6, only a lateral and lengthwise portion of the confronting wall surfaces of the walled casing 26 and side bearing assembly housing 50 is illustrated as inclined or arranged in diverging relation to the opposed surface portion but it should be appreciated the entire width and/or length of the respective wall could be slanted or inclined without any significant detraction or variation from the illustrated principal.

FIG. 8 illustrates an alternative form of adapter or insert for the constant contact side bearing assembly of the present invention. This alternative form of adapter is designated generally by reference numeral 180. The elements of this alternative form of adapter that are functionally analogous to those components of adapter 80 discussed above are designated by reference numerals identical to those listed above with the exception this embodiment uses reference numerals in the 100 series.

As shown in FIG. 8, adapter 180 includes two substantially similar metal pieces 181 and 182. Each adapter piece 181, 182 has a predetermined generally U-shaped configuration preferably sized relative to opposed ends of the side bearing base 50. Since the adapter pieces 181, 182 comprising adapter 180 are substantially similar, only adapter piece 182 will be discussed in detail.

Each adapter piece includes a pair of laterally spaced and vertically upstanding sides 183, 184 rigidly connected to a vertically upstanding end 186. The sides 183, 184 of each adapter piece 181, 182 generally parallel the sides 53, 54 of the side bearing assembly base 50 and longitudinally extend for a distance equal to or less than one-half the length of the side bearing assembly base 50. The end 186 of each adapter piece 181, 182 generally parallels either end 55, 56 of the side bearing assembly base 50. Interior surfaces of the vertically upstanding sides 183, 184 of each piece 181, 182 are separated by a lateral distance only slightly greater than the lateral distance separating the outer or exterior surfaces of the sides 53, 54 of the side bearing assembly base 50. As such, each adapter piece 181, 182 preferably fits about the exterior of one end of the side bearing base 50 with only restricted lateral shifting movements being permitted therebetween.

The sides 183, 184 and end 186 of each adapter piece 181, 182 are joined such that a corner, defining an included angle of about 90°, is provided at the conjuncture of each side 183, 184 and the end 186. Notably, the cumulative thickness of the sides 183, 184 of each adapter piece is about equal to or less than the difference between the lateral width between the exterior surfaces on the sides 53, 54 of the side bearing assembly base 50 and the lateral width between the interior surfaces of the sidewalls 33, 34 of the walled casing 24 thereby inhibiting lateral shifting movements of the side bearing assembly during railcar operation.

Besides being configured to fit about the exterior ends of side bearing assembly base 50, and in the illustrated embodiment, each adapter piece 181, 182 is operably connected to the side bearing assembly base 50. After the adapter pieces 181, 182 are positioned about the ends of the side bearing assembly base 50, the adapter end 186 of each adapter piece 181, 182 and the outer surfaces on the side bearing assembly base ends are arranged in generally confronting relation relative to each other. As such, each bearing piece 181, 182 can be independently and operably connected to the side bearing assembly base 50 using cooperating instrumentalities 187 which, in one form, are substantially similar to cooperating instrumentalities 87 discussed in detail above. Of course, an alternative apparatus similar to that shown in FIG. 7 can be used to independently and operably connect each adapter piece 181, 182 to the side bearing assembly base 50.

After the pieces 181, 182 of adapter 180 are positioned about the side bearing assembly base 50 and within walled casing 24, the relationship between the end 186 of each adapter piece 181 and 182 relative to the ends 55, 56 of the side bearing base 50 and the end walls 35, 36 of the walled casing 24 are substantially similar to each other. To preferably limit lateral and longitudinal shifting movements of the side bearing assembly 40 within the pocket 38, a securement apparatus, generally indicated by reference numeral 190, operably secures each adapter piece 181, 182 to the walled casing 24 thereby positively securing and positioning side bearing assembly 40 relative to the truck bolster 16. The securement apparatus 190 can be substantially similar in design to the securement apparatus 90 discussed in detail above.

Moreover, each adapter piece 181, 182 is preferably configured to further enhance securement of the bearing assembly 40 relative to the bolster 16. More specifically, and as discussed in detail above, at least a lateral portion of the exterior surface of either the end 186 of each bearing piece 181, 182 or the interior surface of the confronting end wall 35, 36 of the casing 24 is preferably configured with a slanting surface 189 to facilitate accommodation of the locking insert or spacer 192 of the securement apparatus 190 therewithin.

FIG. 9 illustrates an alternative form of adapter or insert for the constant contact side bearing assembly of the present invention. This alternative form of adapter is designated generally by reference numeral 280. The elements of this alternative form of adapter that are functionally analogous to those components of adapter 80 discussed above are designated by reference numerals identical to those listed above with the exception this embodiment uses reference numerals in the 200 series.

As shown in FIG. 9, adapter 280 has a predetermined generally U-shaped configuration preferably sized relative to at least one end of the side bearing base 50. In the illustrated form, adapter 280 includes a pair of laterally spaced and vertically upstanding and elongated sides 283, 284 rigidly connected to a vertically upstanding end 286. Each adapter side 283, 284 generally parallels the sides 53, 54 of the side bearing assembly base 50 and longitudinally extends a distance greater than one-half but less than the full length of the side bearing assembly base 50. Interior surfaces of the adapter sides 283, 284 are laterally separated a distance slightly greater than the lateral distance separating exterior surfaces of the sides 53, 54 of the side bearing assembly base 50. As such, adapter piece 280 preferably fits about the exterior of one end of the side bearing base 50 with only restricted lateral shifting movements being permitted therebetween.

The sides 283, 284 and end 286 of adapter 280 are joined such that a corner, defining an included angle of about 90°, is provided at the conjuncture of each side 283, 284 and the end 286. Notably, the cumulative thickness of the sides 283, 284 of adapter 280 is about equal to or less than the difference between the lateral width between the exterior surfaces on the sides 53, 54 of the side bearing assembly base 50 and the lateral width between the interior surfaces of the sidewalls 33, 34 of the walled casing 24 thereby inhibiting lateral shifting movements of the side bearing assembly during railcar operation.

Besides being configured to fit about an exterior end of side bearing assembly base 50, in the form shown in FIG. 8, adapter 280 is operably connected to the side bearing assembly base 50. After adapter 280 is positioned relative to the side bearing assembly base 50, adapter end 286 and an outer surface on one upstanding side bearing assembly base end are arranged in generally confronting relation relative to each other. As such, adapter 280 can be operably connected to the side bearing assembly base 50 using cooperating instrumentalities 287 which, in one form, are substantially similar to the cooperating instrumentalities 87 discussed in detail above. Of course, an alternative apparatus similar to that shown in FIG. 7 can be used to operably connect adapter 280 to the side bearing assembly base 50.

After adapter 280 is positioned relative to the side bearing assembly base 50 within the walled casing 24, the relationship between the end 286 of adapter 280 relative to the ends 56 of the side bearing base 50 and end wall 36 of the walled casing 24 are substantially similar to that shown in FIG. 6. To limit lateral and longitudinal shifting movements of the side bearing assembly 40 within the pocket 38, a securement apparatus, generally indicated in FIG. 8 by reference numeral 290, operably secures the end 286 adapter 280 to the end wall 36 of casing 24 thereby positively securing and positioning side bearing assembly 40 relative to the truck bolster 16. The securement apparatus 290 can be substantially similar in design to the securement apparatus 90 discussed in detail above. Of course, the adapter 280 can be longitudinally reversed from that shown in FIG. 8 without detracting or departing from the invention.

The adapter end 286 is preferably configured to further enhance securement of bearing assembly 40 relative to the bolster 16. More specifically, and as discussed in detail above, at least a lateral portion of or the full width of the exterior surface of the adapter end 286 or a lateral portion or full width of the interior surface of the confronting end wall 36 of the casing 24 is preferably configured with a vertically slanting surface 289*a* to facilitate accommodation of the locking insert or spacer 292 therewithin. Preferably, a similar locking insert or shim 292' can be used at the opposite end of the side bearing assembly for enhancing the securement of the side bearing assembly base 50 and to casing 24. The slanted surface 59 on the respective end of the side bearing base 50 cooperates with end wall 35 of bolster casing 24 to accommodate the shim or insert 292' which, preferably, is similar to insert 92 discussed above whereby facilitating further securement of the side bearing base 50 to the railcar bolster 16.

Figure 10:
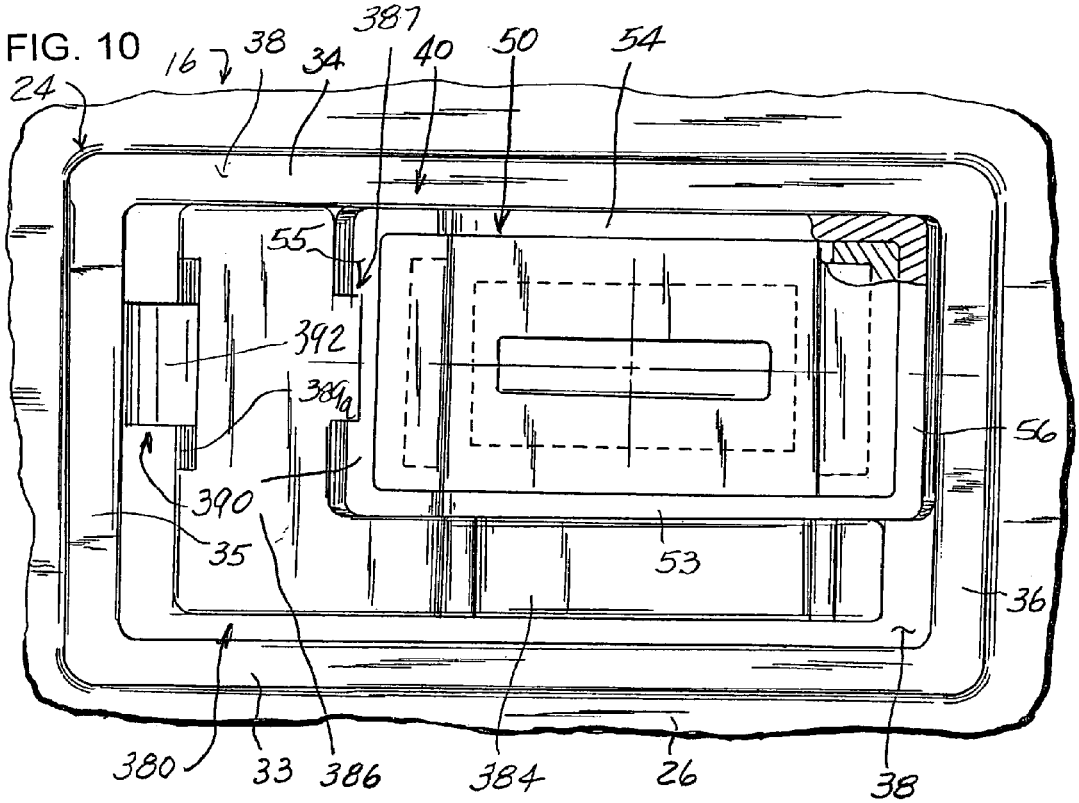
FIG. 10 is a top plan view similar to FIG. 3 showing yet another alternative form of the present invention.

FIG. 10 illustrates another alternative form of adapter or insert for the constant contact side bearing assembly of the present invention. This alternative form of adapter is designated generally by reference numeral 380. The elements of this alternative form of adapter that are functionally analogous to those components of adapter 80 discussed above are designated by reference numerals identical to those listed above with the exception this embodiment uses reference numerals in the 300 series.

As shown in FIG. 10, adapter 380 has a predetermined generally L-shaped configuration preferably sized relative to at least one end of the side bearing base 50. In the illustrated form, adapter 380 includes a vertically upstanding and elongated side 384 rigidly connected to a vertically upstanding end 386. The adapter side 384 longitudinally extends generally parallel to either side 53, 54 of the side bearing base for a distance greater than one-half but less than the length of the side bearing assembly base 50. The adapter end 386 laterally extends generally parallel to either end 55, 56 of the side bearing base 50. Notably, the side 384 and end 386 of adapter 380 are joined such that a corner, defining an included angle of about 90°, is provided at the conjuncture of side 384 and end 386 of adapter 380. The lateral thickness of the adapter side 384 is about equal to or less than the difference between the lateral width between the exterior surfaces on the sides 53, 54 of the side bearing assembly base 50 and the lateral width between the interior surfaces of the sidewalls 33, 34 of casing 24. As such, the adapter 380 inhibits lateral shifting movements of the side bearing assembly during railcar operation. To inhibit longitudinal shifting movements of the side bearing assembly 40 within the pocket 38 of the receptacle 24, the upstanding end 386 of adapter 380 preferably has a width about equal to the longitudinal distance separating the exterior surfaces of the ends 55, 56 of the side bearing assembly 50 from the interior surfaces of the end walls 35, 36 of the walled receptacle 24.

Besides being configured to fit about an exterior end of side bearing assembly base 50, and in a preferred embodiment, adapter 380 is operably connected to the side bearing assembly base 50. After adapter 380 is positioned relative to the side bearing assembly base 50, adapter end 385 and an outer surface on one upstanding side bearing assembly base end are arranged in generally confronting relation relative to each other. As such, adapter 380 can be operably connected to the side bearing assembly base 50 using cooperating instrumentalities 387 which, in one form, are substantially similar to the cooperating instrumentalities 87 discussed in detail above. Of course, an alternative apparatus similar to that shown in FIG. 7 can be used to operably connect the adapter 380 to the side bearing assembly base 50.

After adapter 380 is arranged relative to the side bearing assembly base 50 and within the walled casing 24, the relationship between the adapter end 385, the end 55 of the side bearing base 50, and the end wall 35 of the walled casing 24 constitute substantially a mirror image to that shown in FIG. 6. In a preferred embodiment, and to limit lateral and longitudinal shifting movements of the side bearing assembly 40 within the pocket 38, a securement apparatus, generally indicated in FIG. 10 by reference numeral 390, operably secures adapter end 385 to the end wall 35 of casing 24 thereby positively securing and positioning side bearing assembly 40 relative to the truck bolster 16. Securement apparatus 390 can be substantially similar in design to the securement apparatus 90 discussed in detail above. Of course, adapter 380 can be longitudinally reversed or arranged an operable combination with another corner of the side bearing assembly shown in FIG. 10 without detracting or departing from the invention.

Moreover, the adapter end 385 is preferably configured to further enhance securement of the bearing assembly 40 relative to the bolster 16. More specifically, the exterior surface configuration of the adapter end 385 or the interior surface of the confronting end wall 35 of casing 24 is preferably configured with a vertically inclined or slanting surface 389*a* to facilitate accommodation of the locking insert or spacer 392 of the securement apparatus 390 therewithin thereby facilitating further securement of the side bearing base 50 to the railcar bolster 16. The vertically slanting surface 389*a* laterally extends for at least a portion of or for the full width of the exterior surface of the adapter end 385. Moreover, and like surface 89 illustrated in FIG. 6, surface 389*a* can extend for vertical portion of or the full height of adapter end 385.

Without detracting or departing from the invention, the securement apparatus for operably securing the adapter to the walled casing 24 thereby positively securing and positioning the side bearing assembly 40 relative to the bolster 16 can take different forms. In the form shown, for example in FIG. 11, such securement apparatus includes cooperating instrumentalities in the form of a weld 191 between the adapter and walled casing 24.

It should be appreciated this alternative form or embodiment of a securement apparatus can be used in conjunction with any of the above-described embodiments of the adapter but, for purposes of this description, will be explained in detail in conjunction with adapter 80. As shown by way of example in FIG. 11, the end 86 of adapter 80, arranged in confronting relation to the interior surface of the end wall 36 of casing 24, has an exterior surface wall configuration which substantially parallels the confronting interior wall surface configuration of the end wall 36 of casing 24. That portion of the exterior surface wall configuration of the adapter end 86 which substantially parallels the confronting interior wall surface configuration of the end 36 of casing 24 can extend for a lateral portion of or for the full lateral width of the adapter end 86. Toward the upper end thereof, the adapter end 86 is configured to accommodate a conventional weld 191 extending laterally along and between the end 86 of adapter 80 and end wall 36 of casing 24.

In one form, a step-like recess 95 is defined along at least a lateral portion of an outer edge of the adapter end 86. In a most preferred form, the step-like recess 95 extends about 0.25 to about 0.416 inches inwardly from the outermost surface of the adapter end 86 and about 0.125 and about 0.0437 down from the uppermost surface of the adapter end 86. The purpose of the step-like recess 95 is to accommodate sufficient weld material to laterally and longitudinally position and secure the adapter 80 and, thus, the side bearing assembly 40 in substantially fixed relation relative to the bolster 16 while maintaining the top of the weld 191 below the uppermost edge of the walled casing 24 to prevent interference with the underside of the car body 12 (FIG. 3) during operation of the constant contact side bearing assembly. Of course, a similar weld arrangement can be provided at the opposite end between adapter 80 and the walled casing 24.

FIG. 12 schematically illustrates an alternative form of securement apparatus for operably securing the adapter 80 to the walled casing 24. In the embodiment illustrated in FIG. 12, the end 86 of adapter 80, arranged in confronting relation to the interior surface of the end 36 of casing 24, has an exterior surface wall which substantially parallels the confronting interior wall surface of the end 36 of casing 24. That portion of the exterior surface wall of end 86 which substantially parallels the confronting interior wall surface of the end 36 of casing 24 can extend for a lateral portion of or for the full lateral width of the end 86 of adapter 80. In the embodiment illustrated in FIG. 12, the apparatus for operably securing the adapter 80 to the walled casing 24 has cooperating instrumentalities including weld material 291 between and filling the longitudinal spacing or gap remaining in the pocket 38 between the exterior surface on the ends 85, 86 of the adapter 80 and the interior surfaces of the end walls 35, 36 of casing 24. As such, the side bearing assembly 40 is inhibited from longitudinal shifting movements during operation of the side bearing assembly 40.

Figure 13:
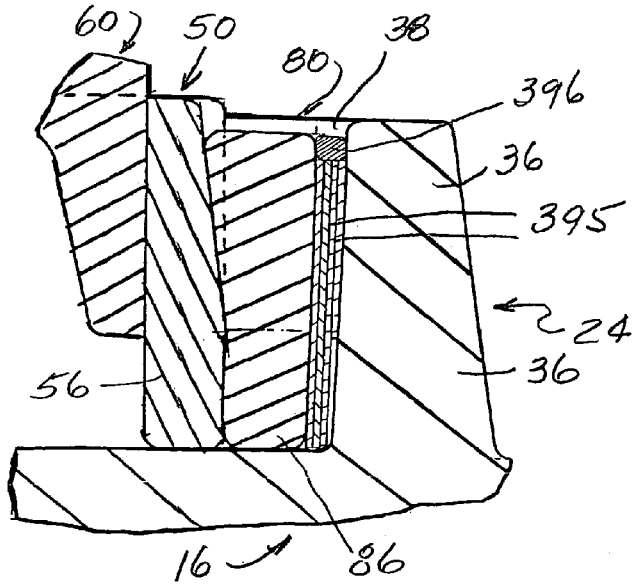
FIG. 13 is a view similar to FIG. 6 but showing another alternative embodiment of an apparatus for securing the side bearing assembly and adapter to a walled receptacle on a railcar bolster.

FIG. 13 schematically illustrates another alternative form of securement apparatus for operably securing the adapter 80 to the walled casing 24. In the embodiment illustrated in FIG. 13, the end 86 of adapter 80, arranged in confronting relation to the interior surface of the end 36 of casing 24, parallels the confronting interior wall surface of the end 36 of casing 24. That portion of the exterior surface wall of adapter end 86 which substantially parallels the confronting interior wall surface of the end 36 of casing 24 can extend for a lateral portion of or for the full lateral width of the end 86 of adapter 80.

In the embodiment illustrated in FIG. 13, the apparatus for operably securing the adapter 80 to the walled casing 24 has cooperating instrumentalities including one or more adjusting shims or spacers 395 between that portion of the exterior surface of each adapter end 85, 86 paralleling the confronting end walls 35, 36 of the walled casing 24 so as to fill the longitudinal spacing or gap remaining in the pocket 38 between the exterior surface on the ends 85, 86 of the adapter 80 and the interior surfaces of the ends 35, 36 of the casing 24. As such, the side bearing assembly 40 is inhibited from longitudinal shifting movements during operation of the side bearing assembly 40. A weld 396 (FIG. 13) is preferably arranged across the top of the adjusting shims or spacers 395 between the exterior surface on the ends 85, 86 of the adapter 80 and the interior surfaces of the ends 35, 36 of the casing 24 to inhibit inadvertent separation of the shims or spacers 395 from the pocket 38 of the walled casing 24.

As the railcar travels over tracks T, the wheeled truck 10 tends to hunt or yaw about a vertical axis of the truck. Accordingly, frictional sliding movements are established at and along the interface of the railcar body underside 42 and the flat engaging surface 62 of the bearing cap 60, thus, creating significant and even excessive heat. As will be appreciated, when the heat developed by the sliding action of the railcar body 12 over the side bearing assembly 40 exceeds the heat deflection temperature of the thermoplastic elastomer 75, deterioration, deformation and even melting of the spring 70 can result, thus, adversely affecting side bearing performance.

Accordingly, another aspect of the invention relates to configuring the side bearing assembly 40 including adapter 80 so as to promote dissipation of heat away from the elastomeric spring 70 thereby prolonging the usefulness of the side bearing assembly 40. Toward those ends, and in the form shown in FIG. 2, the height of at least a midportion of the side walls 53, 54 of bearing housing 50 is significantly reduced relative to the height of the end walls 55, 56. Moreover, the bearing cap 60 is preferably configured to promote dissipation of heat away from the spring 70. The reduced height of the housing sides 53, 54, and the preferred configuration of the bearing cap 60, independently and in combination, readily allows air to freely flow into and through the cavity 52 in the bearing assembly 40 whereby promoting dissipation of heat away from the side bearing spring 70. Additionally, configuring the bearing cap 60 with the elongated throughbore or opening 67 moves heat generated from the friction engagement of the bearing cap 60 with the railcar body underside 42 toward the peripheral edges of the cap 60 and away from the elastomeric spring 70 which is normally susceptible to heat damage.

Preferably, the adapter 80 is furthermore configured to promote the dissipation of heat away from the side bearing assembly 40. As shown in FIGS. 2, 4 and 5, the adapter sides 83, 84 are preferably configured to complement the reduced height of the sides 53, 54 on the side bearing base 50 and, in combination, readily allows air to freely flow into and through the cavity 52 in the bearing assembly 40 whereby promoting dissipation of heat away from the side bearing spring 70. Suffice it to say, the alternative forms of adapter shown in FIGS. 8, 9 and 10 are similarly configured to promoting dissipation of heat away from the side bearing spring 70.

In those embodiments of the bearing assembly having a bottomless housing design, spring 70, regardless of its design, is permitted to extend through the bottom of the bearing housing to directly abut and engage the upper surface 28 of the bolster 16. As such, the vertical space normally consumed or taken by a bottom wall of the bearing assembly cage or housing has been eliminated and advantageously used to reduce the overall height of and provide a low profile to the bearing assembly 40. Whereas, in one form for the bearing assembly 40, the measurable distance between the upper friction engaging surface 62 and the lowermost wall structure surface of the bearing housing 50 ranges between about 2.5 inches and about 4.5 inches. In another design, the bottomless design of the housing assembly yields a bearing assembly having a side profile measuring about 2.625 inches in overall height.

Another important feature of the present invention involves maintaining the friction surface 62 of assembly 40 in substantially constant contact with the underside 42 of the railcar body 12. As such, hunting or yawing motions of the wheeled truck 10 are reduced, thus, yielding improved performance to the railcar. Moreover, when rolling movements of the railcar body 12 are excessive, the side bearing assembly 40 and the adapter 80 allow the car body to "go solid" into the bolster 16 through the walled receptacle 26 on the truck bolster 16 whereby limiting damages to and this prolonging the life of the side bearing assembly 40.

In addition to the above, the side bearing assembly 40 including adapter 80 are configured to be accommodated within existing housing structures on the bolster. As such, there is no need to spend valuable time removing or cutting away the existing housing structure on the bolster. In a preferred embodiment, the side bearing assembly 40 is configured to loosely fit within different size pockets defined by the existing housing or receptacle on the bolster. Thereafter, adapter 80 is used to both longitudinally and laterally locate the constant contact side bearing assembly 40 in the pocket 38 defined by and relative to the railcar bolster 16.

From the foregoing, it will be observed numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A constant contact side bearing assembly for a railcar having a bolster with an upper surface and a walled receptacle fixed to and upstanding from the upper surface of said bolster, with an inner surface of said walled receptacle defining an open-top cavity, said side bearing assembly comprising:

a spring;

a generally rectangular base defining a recess wherein said spring is accommodated, said base being configured to loosely fit within the open-top cavity of said walled receptacle such that a gap is defined between an outer surface of the base of said side bearing and the inner surface of said walled receptacle, a friction member having an upper, generally flat railcar engaging surface portion biased under the influence of said spring against an underside of said railcar, with said friction member being telescopically guided by interior and upstanding wall structure on said base for vertical reciprocatory movements relative to said bolster; and an adapter having an inner corner and which is fitted between two walls on an outer surface of the side bearing assembly base and the inner surface of said walled receptacle to, at least partially, fill said gap and positively position said side bearing assembly, both laterally and longitudinally, within the open-top cavity of said walled receptacle such that horizontal shifting movements of said side bearing assembly base are reduced relative to said bolster.

2. The side bearing assembly according to claim 1, further including an apparatus for operably securing said adapter to said walled receptacle.

3. The side bearing assembly according to claim 2, wherein the outer surface of said adapter and the inner surface of said walled receptacle define generally upstanding vertical confronting surfaces, and wherein said apparatus for securing said adapter to said walled receptacle includes cooperating instrumentalities disposed between said confronting surfaces for securing said adapter and walled receptacle in generally fixed relation relative to each other.

4. The side bearing assembly according to claim 1, wherein said base and said adapter define cooperating instrumentalities therebetween for inhibiting shifting movements of said base and adapter relative to each other.

5. The side bearing assembly according to claim 1, further including an apparatus for operably securing the side bearing assembly base and said adapter in operable combination relative to each other.

6. The side bearing assembly according to claim 5, wherein said apparatus for operably securing the side bearing assembly base and said adapter in operable combination includes cooperating instrumentalities between said side bearing assembly base and said adapter.

7. The side bearing assembly according to claim 6, wherein ends of said side bearing assembly base and ends of said adapter define a pair of confronting surfaces therebetween.

8. The side bearing assembly according to claim 7, wherein the cooperating instrumentalities between said side bearing assembly base and said adapter include configuring a vertical portion of each of said confronting surfaces at substantially similar vertically inclined angles such that an inclined surface portion on said side bearing base operably engages with a substantially similar inclined surface portion on said adapter whereby inhibiting shifting movements after said adapter is positioned about said base and is secured to said walled receptacle.

9. A constant contact side bearing assembly for a railcar having a bolster extending transverse relative to a longitudinal axis of said railcar, a rectangular open-top casing upwardly projecting from an upper surface of said bolster, said casing having a pair of transversely spaced generally parallel sidewalls and a pair of longitudinally spaced end walls, said constant contact side bearing assembly comprising:

a base defining a recess between two transversely spaced sides rigidly joined to two longitudinally spaced and upstanding ends, with the spacing between the sides and ends of said base being less than the spacing between the sidewalls and end walls of said rectangular open-top casing such that said side bearing assembly base is loosely arranged within said casing and a gap is provided between an outer surface on the sides and ends of the base relative to an inner surface on the sidewalls and end walls of said casing;

a cap defining an upper friction engaging surface for said side bearing assembly along with structure depending from said surface, with said depending structure on said cap being telescopically guided by the upstanding ends of said base;

a resilient member arranged within the recess defined by said base and operable to urge the friction engaging surface of said gap into frictional sliding contact with an underside of said railcar; and an adapter having an inner corner and which is fitted between at least one side and one end on the outer surface of the side bearing assembly base and the inner surface of said rectangular casing thereby filling the gaps therebetween while positively positioning, both longitudinally and laterally, said side bearing assembly base relative to said casing while inhibiting horizontal shifting of said side bearing assembly base relative to said bolster.

10. The constant contact side bearing assembly according to claim 9, wherein said resilient member includes an elastomeric spring.

11. The constant contact side bearing assembly according to claim 9, wherein said side bearing assembly base is formed from austempered ductile iron material.

12. The side bearing assembly according to claim 9, further including an apparatus for operably securing said adapter to said casing.

13. The side bearing assembly according to claim 12, wherein an outer surface of said adapter and an inner surface of said casing define generally upstanding vertical confronting surfaces, and wherein said apparatus for operably securing said adapter to said casing includes cooperating instrumentalities disposed between said confronting surfaces for securing said adapter and casing in generally fixed relation relative to each other after said adapter is fitted about the side bearing assembly base.

14. The side bearing assembly according to claim 9, further including an apparatus for operably securing the side bearing assembly base and said adapter in operable combination relative to each other.

15. The side bearing assembly according to claim 14, wherein said apparatus for operably securing the side bearing assembly base and said adapter in operable combination includes cooperating instrumentalities between said side bearing assembly base and said adapter.

16. The side bearing assembly according to claim 9, wherein said adapter has a generally L-shaped configuration, with one leg of said adapter extending between the sidewall of said casing and a side of said side bearing assembly base and a second leg extending between one end wall of said casing and an end of said side bearing assembly base.

17. A constant contact side bearing assembly for a railcar having a bolster extending transverse relative to a longitudinal axis of said railcar, a rectangular open-top casing upwardly projecting from an upper surface of said bolster, said casing having a pair of transversely spaced generally parallel sidewalls and a pair of longitudinally spaced end walls, said constant contact side bearing assembly comprising:

a spring;

a generally rectangularly shaped base defining a recess wherein said spring is accommodated, with said base having two transversely spaced sides joined to two longitudinally spaced upstanding ends, with the transverse spacing between the sides and the longitudinal spacing between the ends of said housing being less than the transverse spacing between the sidewalls and the longitudinal spacing between the end walls of said casing such that a gap is provided between an outer surface of said base and an interior of said open-top rectangular casing after said side bearing is arranged in operable combination therewith;

a cap vertically positioned by and overlying one end of said spring, with said cap including an upper generally flat surface with a pair of longitudinally spaced ends depending from said flat surface, with the longitudinal spacing between an outer surface on the ends of said cap being generally equal to the longitudinal spacing between inner surfaces on the longitudinally spaced upstanding ends of said base such that, when the cap and base are assembled, said cap moves along and is guided by the inner surfaces of the upstanding ends of said base for vertical movements of said cap relative to said base while preventing substantial longitudinal shifting movements of said cap relative to said base; and an adapter defining at least one corner and which is configured to fit within and substantially fill the gap between the outer surface of the base of said side bearing and the inner surface of said casing.

18. The constant contact side bearing assembly according to claim 17, wherein said side bearing assembly base is formed from austempered ductile iron.

19. The constant contact side bearing assembly according to claim 17, further including an apparatus for inhibiting longitudinal shifting movement of said adapter relative to said casing after said side bearing assembly is arranged in operable combination with said casing and said adapter is fitted about said base.

20. The constant contact side bearing assembly according to claim 19, wherein an outer surface of said adapter and an inner surface of said casing define generally upstanding vertical confronting surfaces, and wherein said apparatus for inhibiting longitudinal shifting movement of said adapter relative to said casing includes cooperating instrumentalities disposed between said confronting surfaces for securing said adapter and casing in generally fixed relation relative to each other after said adapter is fitted about said side bearing assembly base.

21. The constant contact side bearing assembly according to claim 17, further including an apparatus for inhibiting longitudinal shifting movements of said base and adapter relative to each other.

22. The constant contact side bearing assembly according to claim 17, wherein said adapter has a generally L-shaped configuration, with one leg of said adapter extending between the sidewall of said casing and a side of said side bearing assembly base and a second leg extending between the end wall of said casing and an end of said side bearing assembly base.

23. The side bearing assembly according to claim 20, wherein at least a vertical portion of the confronting surfaces between each end of said side bearing assembly base and each end of said adapter is configured at substantially similar vertically inclined angles such that an inclined surface portion on said base operably engages with a substantially similar inclined surface portion on said adapter whereby inhibiting shifting movements after said adapter is positioned about said base and is secured to said casing.

24. A constant contact side bearing assembly for a railcar having a bolster with an upper surface and a walled receptacle upstanding from the upper surface of the bolster, with an inner surface of the walled receptacle defining an open-top cavity wherein the side bearing assembly is accommodated, and with said side bearing assembly comprising:

a generally rectangular base configured to loosely fit within the walled receptacle such that a gap is defined between an outer surface of the side bearing assembly base and the inner surface of the walled receptacle;

a spring carried by said base;

a friction member having a railcar engaging surface portion biased by the spring against an underside of the railcar; and an adapter having a corner and which is fitted between a side and an end of the side bearing assembly base and the walled receptacle to, at least partially, fill the gap between the side bearing assembly base and the interior surface of the walled receptacle thereby positively positioning, both laterally and longitudinally, the side bearing assembly while reducing horizontal shifting movements of the side bearing assembly relative to the bolster to optimize performance of the side bearing assembly.

25. The constant contact side bearing assembly according to claim 24, wherein said adapter has a generally L-shaped configuration.

26. The constant contact side bearing assembly according to claim 24, wherein said friction member include wall structure depending from said flat railcar engaging surface portion and which is telescopically guided by upstanding wall structure on said base for vertical reciprocatory movements relative to said bolster.

27. The constant contact side bearing assembly according to claim 24, further including an apparatus for operably securing said adapter to said walled receptacle.

28. The constant contact side bearing assembly according to claim 27, wherein the outer surface of said adapter and the inner surface of said walled receptacle define generally upstanding vertical confronting surfaces, and wherein said apparatus for operably securing said adapter to said walled receptacle includes cooperating instrumentalities disposed between said confronting surfaces for securing said adapter and walled receptacle in generally fixed relation relative to each other.

29. The constant contact side bearing assembly according to claim 24, wherein said base and said adapter define cooperating instrumentalities therebetween for inhibiting shifting movements of said base and adapter relative to each other.

30. The constant contact side bearing assembly according to claim 24, further including an apparatus for operably securing the side bearing assembly base and said adapter in operable combination relative to each other.

31. The constant contact side bearing assembly according to claim 30, wherein said apparatus for operably securing the side bearing assembly base and said adapter in operable combination includes cooperating instrumentalities between said side bearing assembly base and said adapter.

32. The constant contact side bearing assembly according to claim 31, wherein ends of said side bearing assembly base and ends of said adapter define a pair of confronting surfaces therebetween.

33. The constant contact side bearing assembly according to claim 32, wherein the cooperating instrumentalities between said side bearing assembly base and said adapter include configuring a vertical portion of each of said confronting surfaces at substantially similar vertically inclined angles such that an inclined surface portion on said side bearing base operably engages with a substantially similar inclined surface portion on said adapter whereby inhibiting shifting movements after said adapter is positioned about said base and is secured to said walled receptacle.

* * * * *